US006863227B2

(12) United States Patent
Wollenberg et al.

(10) Patent No.: US 6,863,227 B2
(45) Date of Patent: Mar. 8, 2005

(54) APPARATUS AND METHODS FOR SWIVEL ATTACHMENT OF SUPPLY VESSELS TO APPLICATOR DEVICES

(75) Inventors: Skye Lechner Wollenberg, Seattle, WA (US); Neil Garrett Stockman, Des Moines, WA (US)

(73) Assignee: Trade Associates, Inc., Auburn, WA (US)

( * ) Notice: Subject to any disclaimer, the term of this patent is extended or adjusted under 35 U.S.C. 154(b) by 0 days.

(21) Appl. No.: 10/608,058

(22) Filed: Jun. 27, 2003

(65) Prior Publication Data

US 2004/0069816 A1 Apr. 15, 2004

Related U.S. Application Data

(63) Continuation-in-part of application No. 10/272,230, filed on Oct. 15, 2002, now abandoned.

(51) Int. Cl.[7] ..... B05B 7/30
(52) U.S. Cl. ..... 239/345; 239/379; 285/146.1
(58) Field of Search ..... 239/587.1–587.4, 239/376, 379, 340, 346, 353, 433, 345; 285/146.1, 146.3

(56) References Cited

U.S. PATENT DOCUMENTS

| | | | | | |
|---|---|---|---|---|---|
| 2,647,796 | A | * | 8/1953 | Ziherl | 239/470 |
| 4,035,004 | A | * | 7/1977 | Hengesbach | 285/146.1 |
| 4,273,289 | A | * | 6/1981 | Jette | 239/458 |
| 4,456,180 | A | | 6/1984 | Lury | 239/397 |
| 4,537,357 | A | | 8/1985 | Culbertson et al. | 239/290 |
| 4,739,933 | A | | 4/1988 | Hanano | 239/304 |
| 4,805,814 | A | | 2/1989 | Allen, Sr. | 222/538 |
| 4,817,872 | A | | 4/1989 | Mattson | 239/300 |
| 4,959,159 | A | | 9/1990 | Mattson | 239/526 |
| 5,094,402 | A | | 3/1992 | Perret, Jr. et al. | 239/526 |
| 5,271,564 | A | | 12/1993 | Smith | 239/532 |
| 5,469,993 | A | | 11/1995 | Hauf et al. | 222/383.3 |
| 5,609,302 | A | | 3/1997 | Smith | 239/526 |
| 5,803,360 | A | * | 9/1998 | Spitznagel | 239/345 |
| 6,029,909 | A | | 2/2000 | Smith | 239/318 |
| 6,168,093 | B1 | | 1/2001 | Greer, Jr. et al. | 239/332 |
| 6,319,453 | B1 | | 11/2001 | Klima, Jr. et al. | 264/504 |
| 6,409,103 | B1 | * | 6/2002 | Norville et al. | 239/587.1 |
| 6,443,332 | B1 | * | 9/2002 | Costea | 222/321.1 |

OTHER PUBLICATIONS

Website page for "Atom–miser®IQ™", Atom–miser® IQ™Top–Load and "IQ™–2Q Two–Quart Capacity System", Mattson Automotive Spray Equipment, pp. 1–3, http://www.mattsonspray.com/auto/auto.html, Dec. 3, 2002.

* cited by examiner

*Primary Examiner*—Gene Mancene
*Assistant Examiner*—Patrick Buechner
(74) *Attorney, Agent, or Firm*—Dorsey & Whitney LLP

(57) ABSTRACT

Apparatus and methods for swivel attachment of supply vessels to applicator devices are disclosed. In one embodiment, an apparatus includes an applicator device, a supply vessel having an interior volume, and a swivel assembly coupled between the supply vessel and the applicator device. The swivel assembly includes a first engagement member having a protruding portion and a first passageway disposed therethrough, and a second engagement member having a concavity and a second passageway disposed therethrough, the protruding portion being moveably engaged within the concavity such that the interior volume of the supply vessel fluidly communicates with the applicator device through the first and second passageways.

27 Claims, 7 Drawing Sheets

APPARATUS AND METHODS FOR SWIVEL ATTACHMENT OF SUPPLY VESSELS TO APPLICATOR DEVICES

CROSS-REFERENCE TO RELATED APPLICATION

This application is a continuation-in-part of pending U.S. patent application Ser. No. 10/272,230, filed Oct. 15, 2002 now abandoned.

TECHNICAL FIELD

The present invention relates to equipment for applying liquid coating materials to a surface, and more particularly, to apparatus and methods for swivel attachment of supply vessels to applicator devices, including sprayers, spray guns, pads, porous members, and the like.

BACKGROUND OF THE INVENTION

A wide variety of equipment for applying liquids such as paint, varnish, or other coating materials are known. Some types of hand held applicator devices for applying liquid coating materials to a surface have a supply vessel attached directly to the applicator device that utilize the force of gravity to supply the coating material to the applicator device.

One example of an applicator device that utilizes a gravity-feed supply vessel is a hand-held spray assembly 10 for applying coating materials such as paint as shown in FIG. 1. As shown in FIG. 1, the spray assembly 10 includes a spray gun 12 coupled to a supply vessel 14. The spray gun 12 is also coupled to a pressure source 16, such as an air compressor or gas bottle. The spray gun 12 includes a nozzle 18 for applying a spray or stream 20 of a liquid coating material (e.g. paint) onto a workpiece 22, and a trigger 24 for controlling a rate of flow of the liquid coating material from the nozzle 18 in a conventional manner widely known in the art.

The supply vessel 14 includes a threaded aperture 26 that threadedly engages a threaded mounting nipple 28 on the spray gun 12, and a removable cover 34 that allows the supply vessel 14 to be filled. The supply vessel 14 is rigidly attached onto the threaded mounting nipple 28 of the spray gun 12 in a tilted position such that a central axis 30 of the supply vessel 14 forms a tilt angle I with respect to a nozzle axis 32 passing through a centerline of the nozzle 18. Typically, the tilt angle I of the conventional spray assembly 10 is approximately 45 degrees, allowing gravitational feed of the liquid coating material from the supply vessel 14 into the spray gun 12 throughout a range of positions of the nozzle axis 32, including vertical (as shown in FIG. 1) to horizontal and slightly beyond.

Although desirable results have been achieved using prior art spray assemblies 10, some operational drawbacks exist. For example, in an operating position 36 shown in FIG. 1, the nozzle axis 32 is positioned perpendicular to the horizontal surface of the workpiece 22 so that the spray 20 is applied uniformly to the workpiece 22. In this position 36, however, the liquid coating material in the supply vessel 14 may only be filled to a maximum safe-operating level 38. Thus, the interior volume of the supply vessel 14 is typically not fully utilized when the spray assembly 10 is operated in the operating position 36. If the spray assembly 10 is rotated in a clockwise direction R so that the nozzle axis 32 is not perpendicular to the workpiece 22, the supply vessel 14 may be filled to a higher level, however, in such a rotated position (not shown) the spray 20 is not uniformly applied to the workpiece 22, resulting in an unacceptable degradation of performance. Also, when the nozzle axis 32 is rotated away from the perpendicular position 36 the transfer efficiency defined as that percentage of the spray 20 that actually adheres to the surface of the workpiece 22 is reduced, resulting in increased waste and possibly adverse conditions within the surrounding atmosphere. For these reasons, the interior volume of the supply vessel 14 is typically not fully utilized, and the supply vessel 14 must be filled more frequently during operation of the spray assembly 10, resulting in decreased efficiencies and higher costs.

Similarly, FIG. 2 shows the spray assembly 10 in an upwardly directed position 40. In this position, the liquid coating material in the supply vessel 14 flows to a non-operational level 42 so that no coating material is supplied to the spray gun 12. Consequently, the spray gun 12 only emits a spray of gas 44 from the pressure source 16. Furthermore, in the upwardly directed position 40, the coating material exerts pressure on the removable cover 34, and the danger of an accidental spill 46 of the coating material is increased.

SUMMARY OF THE INVENTION

The present invention is directed to apparatus and methods for swivel attachment of supply vessels to application devices, such as sprayers, spray guns, applicators, and the like. In one aspect, an apparatus includes an applicator device, a supply vessel having an interior volume, and a swivel assembly coupled between the supply vessel and the applicator device. The swivel assembly includes a first engagement member having a protruding portion and a first passageway disposed therethrough, and a second engagement member having a concavity and a second passageway disposed therethrough, the protruding portion being moveably engaged within the concavity such that the interior volume of the supply vessel fluidly communicates with the applicator device through the first and second passageways. The inventive apparatus may provide increased efficiency, reduced labor costs, and reduced risks of spillage compared with prior art devices.

DETAILED DESCRIPTION OF THE INVENTION

The present description is generally directed toward novel apparatus and methods for swivel attachment of supply vessels to applicator devices. Many specific details of certain embodiments of the invention are set forth in the following description and in FIGS. 3–12 to provide a thorough understanding of such embodiments. One skilled in the art will understand, however, that the present invention may have additional embodiments, or that the present invention may be practiced without several of the details described in the following description.

Figure 3:
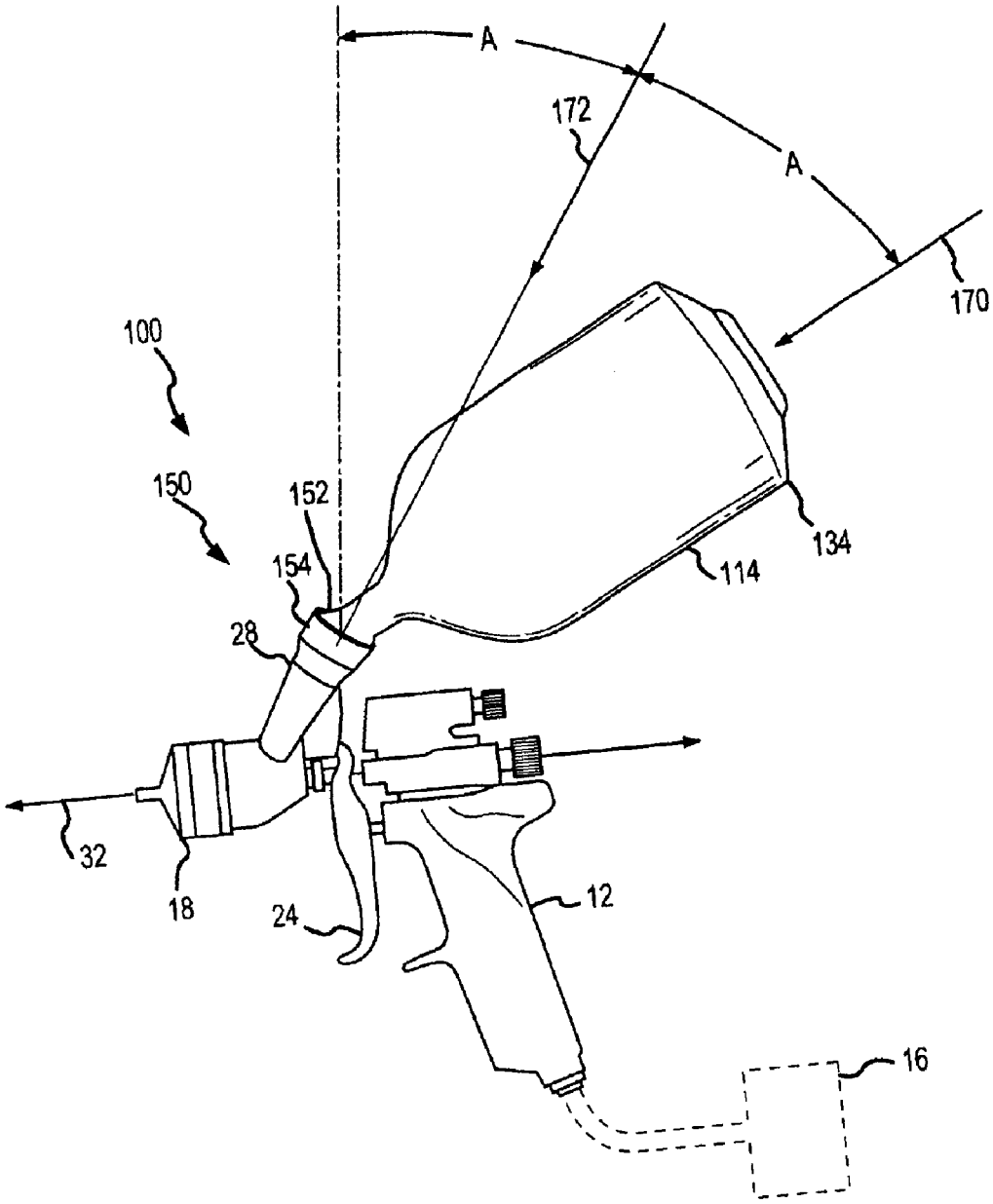
FIG. 3 is a side elevational view of a spray gun assembly in accordance with an embodiment of the invention.

FIG. 3 is a side elevational view of a spray assembly 100 in accordance with an embodiment of the invention. As shown in FIG. 3, the spray assembly 100 includes a supply vessel 114 moveably coupled to a spray gun 12 by a swivel assembly 150. The spray gun 12 is of conventional design, and the supply vessel 114 includes a removable cover 134. The swivel assembly 150 includes a first engagement member 152 coupled to the supply vessel 114, and a second engagement member 154 coupled to the spray gun 12. As described more fully below, the swivel assembly 150 couples the supply vessel 114 to the spray gun 12 in a pivotable and rotatable manner, providing significant advantages in operational capability and efficiency compared with prior art devices.

Figure 4:
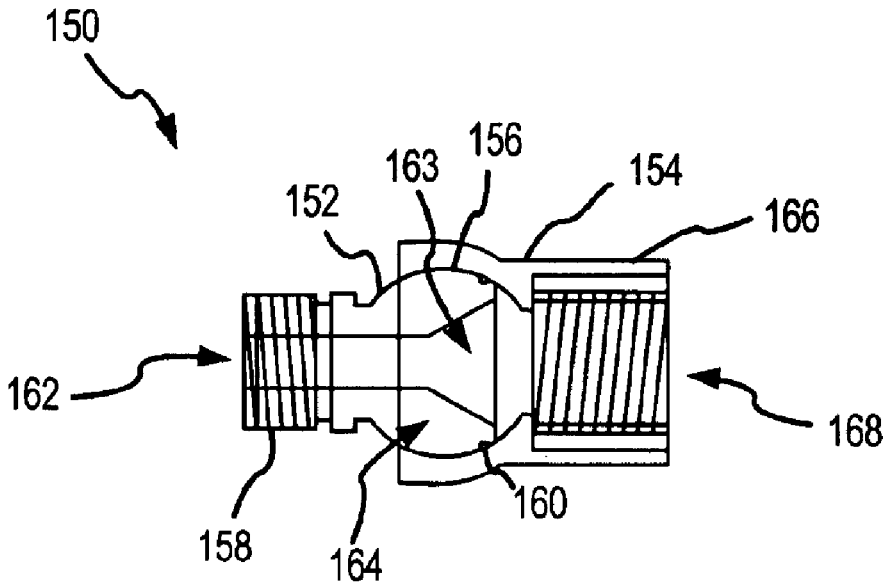
FIG. 4 is side elevational view of a swivel assembly of the spray gun assembly of FIG. 3.
Figure 5:
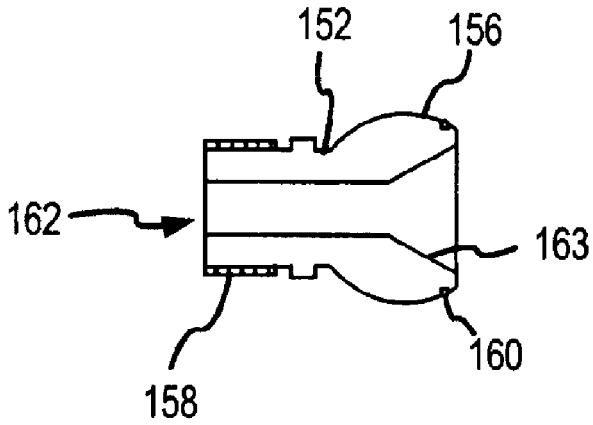
FIG. 5 is a side cross sectional view of a first engagement member of the swivel assembly of FIG. 4.
Figure 6:
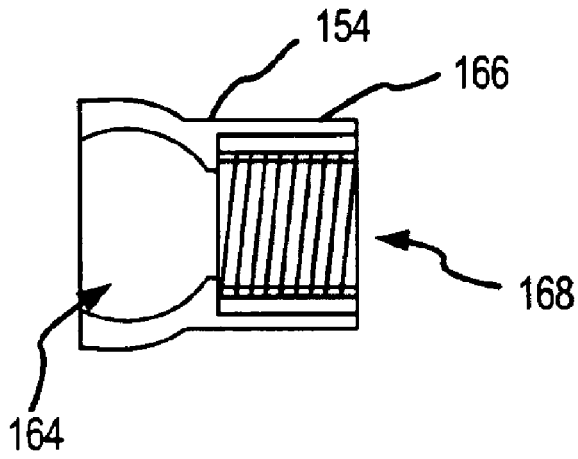
FIG. 6 is a side cross sectional view of a second engagement member of the swivel assembly of FIG. 4.

FIG. 4 is side elevational view of the swivel assembly 150 of FIG. 3. FIGS. 5 and 6 are side cross sectional views of the first and second engagement members 152, 154 of the swivel assembly 150 of FIG. 4. As best shown in FIGS. 4 and 5, the first engagement member 152 includes a protruding portion 156 that engages with the second engagement member 154, and a threaded base portion 158 that threadedly engages the supply vessel 114 (FIG. 3). An O-ring seal 160 is disposed in the protruding portion 156. A first passageway 162 is disposed through the first engagement member 152, the first passageway 162 having a flared or conical segment 163 at an end thereof proximate to the second engagement member 154.

As shown in FIGS. 4 and 6, the second engagement member 154 has a concavity 164 formed therein that is sized to receive the protruding portion 156 of the first engagement member 152, and an internally-threaded mounting portion 166 that threadedly engages the mounting nipple 28 on the spray gun 12. A second passageway 168 is disposed through the second engagement member 154. In the assembled position (FIG. 4), the first and second passageways 162, 168 are in fluid communication so that a liquid coating material may flow from the supply vessel 114 through the first and second passageways 162, 168 and into the spray gun 12.

In one embodiment, the first and second engagement members 152, 154 are formed from different materials, one being more flexible than the other to allow an expandable, press fitting between these components. In a particular embodiment, for example, the protruding portion 152 is formed from a plastic material, and the second engagement member 154 surrounding the concavity 164 is formed from aluminum.

Figure 1:
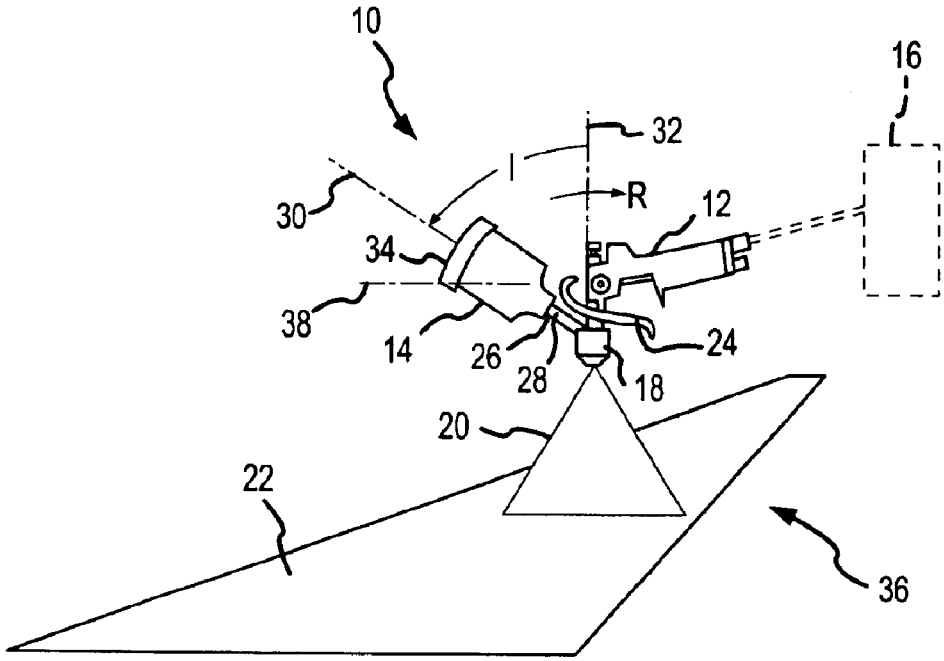
FIG.1 (PRIOR ART)
FIG. 1 is a schematic view of a spray gun assembly in a first operating condition in accordance with the prior art.
Figure 2:
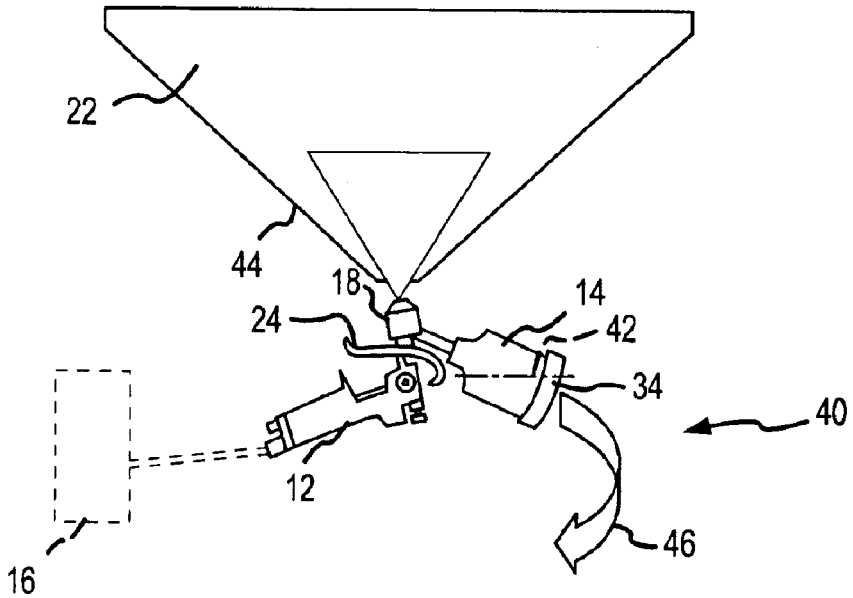
FIG.2 (PRIOR ART)
FIG. 2 is a schematic view of the spray gun assembly of FIG. 1 in a second operating condition.
Figure 7:
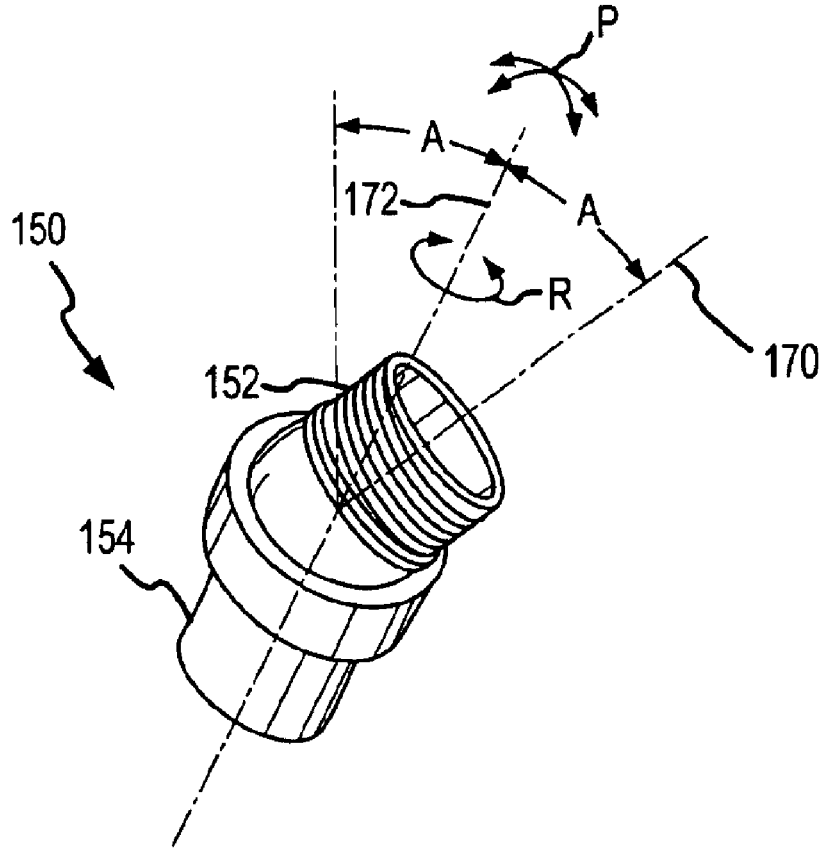
FIG. 7 is an isometric, schematic view of the swivel assembly of FIG. 4.

FIG. 7 is an isometric, schematic view of the swivel assembly 150 of FIG. 4. As shown in FIGS. 3 and 7, a first longitudinal axis 170 extends through the first passageway 162 of the first engagement member 152, and a second longitudinal axis 172 extends through the second passageway 168 of the second engagement member 154. When the swivel assembly 150 is mounted on the spray gun 12 the second longitudinal axis 172 corresponds to the central axis 30 of the supply vessel 14 of the prior art spray assembly 10 described above and shown in FIG. 1.

In operation, as shown in FIG. 7, the swivel assembly 150 enables the first engagement member 152, and thus the supply vessel 114, to be pivoted through a pivot angle A in any direction with respect to the second longitudinal axis 172 (shown by arrows P). Similarly, in this embodiment, the swivel assembly 150 also permits the first engagement member 152 and the attached supply vessel 114 to be rotated in either direction (designated by arrow R) about the second longitudinal axis 172. The tolerances between the first and second engagement members 152, 154 are selected to provide a desired degree of frictional engagement between the protruding portion 156 and the concavity 164 so that the pivot angle A may be adjusted and controlled by an operator during operation of the spray assembly 100 simply by grasping the supply vessel 114 and moving it into a desired position. Once in the desired position, the frictional engagement between the protruding portion 156 and the concavity 164 maintains the supply vessel 114 in the desired position during operation of the spray assembly 100.

The swivel assembly 150 advantageously allows adjustment of the position of the supply vessel 114 with respect to the spray gun 12 without locking devices, locking nuts, threaded sections, screws, or other cumbersome devices. Because the frictional engagement between the first and second engagement members 152, 154 allows the position of the supply vessel 114 to be controllably positioned by hand during operation of the spray assembly 100, there is no need for the operator to stop the spraying operation to may adjustments. Also, in some operating conditions, the spray assembly 100 enables the operator to adjust the position of the supply vessel 114 to improve the operator's view of the workpiece 22.

One may note that several aspects of the swivel assembly 150 may be modified from the particular embodiment shown in FIGS. 3–7 without departing from the spirit and scope of the invention. For example, one may note that the swivel assembly 150 may be inverted from that configuration shown in the accompanying figures so that the first engagement member 152 is coupled to the spray gun 12 and the second engagement member 154 is coupled to the supply vessel 114. Another possible design variation is that the first and second engagement members 152, 154 may be either male or female threaded to accommodate a variety of supply vessels or spray guns offered by various manufacturers. Likewise, the O-ring seal 160 may be disposed within the concavity 164 rather than in the protruding portion 156. Furthermore, the first and second engagement members 152, 154 need not be threadedly engaged with the spray gun 12 and supply vessel 114, but may be coupled using any suitable attachment mechanism, including snap-on or quick-disconnect fittings, press fittings, welding, or any other attachment mechanism. Alternately, one or both of the first and second engagement members 152, 154 may be integrally formed with the respective spray gun and supply vessel components.

Furthermore, in the embodiment shown in FIGS. 3–7, the protruding portion 156 is a partially-spherically shaped portion, and the concavity 164 is a correspondingly partially-spherically shaped concavity. This embodiment advantageously enables pivotal movement of the first engagement member 152 in any direction with respect to the second engagement member 154, and also enables rotational motion of the first engagement member 152 with respect to the second engagement member 154. In alternate embodiments, however, a variety of alternate shapes of protruding portions and concavities may be conceived that provide at least some pivotal and/or rotational motion of the first engagement member 152 with respect to the second engagement member 154, including, for example, semi-cylindrical shaped portions and corresponding cavities that provide more limited pivotal freedom of movement in specific planes of motion.

Figure 8:
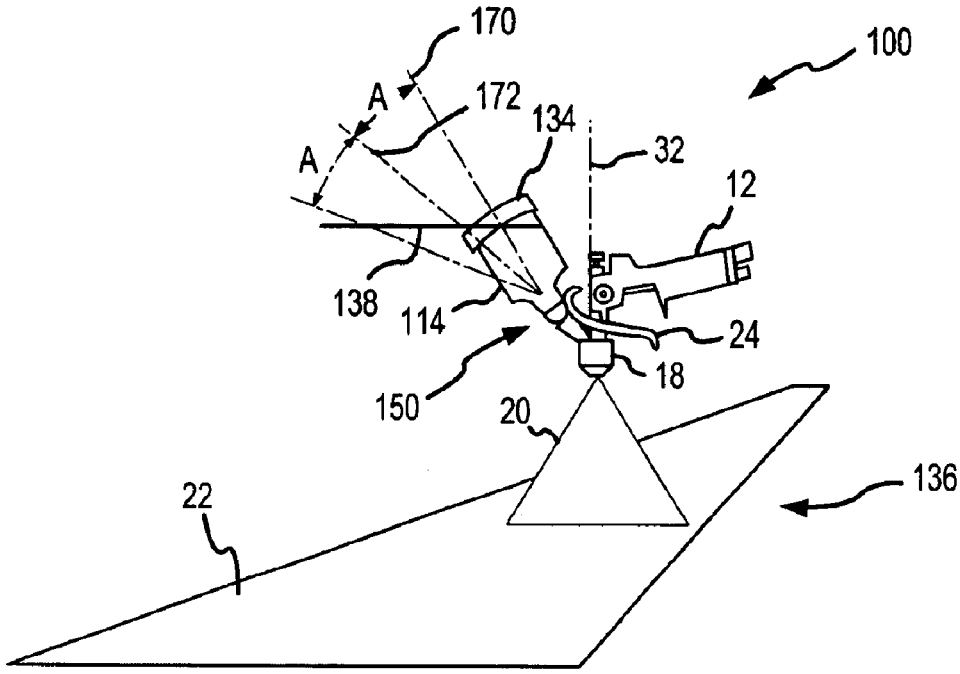
FIG. 8 is a schematic view of the spray gun assembly of FIG. 3 in a first operating condition.

FIG. 8 is a schematic view of the spray assembly 100 of FIG. 3 in an optimal operating condition 136 with the nozzle axis 32 positioned perpendicular to the horizontal surface of the workpiece 22 so that the spray 20 of coating material is applied uniformly to the workpiece 22. Because the supply vessel 114 may be tilted into a more upright position through the tilt angle A, the liquid coating material in the supply vessel 114 may be filled to a maximum safe-operating level 138 that is higher than that level 38 available using the prior art assembly 10. Therefore, the interior volume of the supply vessel 114 may be more fully utilized, resulting in more area of the workpiece 22 being covered be loading of the supply vessel 114, and greater overall efficiency of the device and reduced labor costs compared with the prior art assembly 10.

Figure 9:
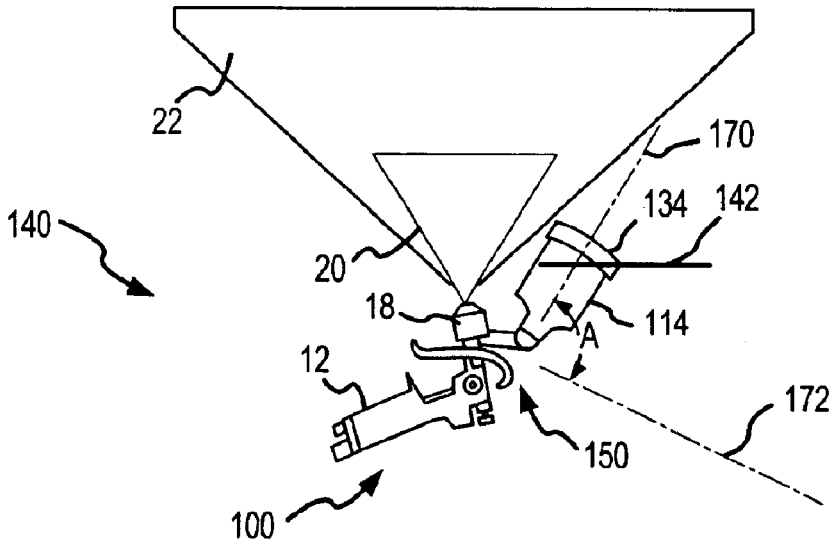
FIG. 9 is a schematic view of the spray gun assembly of FIG. 3 in a second operating condition.

Similarly, FIG. 9 is a schematic view of the spray assembly 100 in an upwardly directed position 140. In this position 140, the supply vessel 114 is pivoted using the swivel assembly 150 (or an alternate embodiment thereof) so that the liquid coating material in the supply vessel 114 remains at an operational level 142 for gravitational feeding into the spray gun 12. Consequently, the spray gun 12 is able to emit a spray 20 of coating material onto the downwardly-facing surface of the workpiece 22. In this way, the inventive swivel assembly 150 facilitates the preferred vertical position of the spray gun 12 for even application of the liquid material onto the workpiece 22. Furthermore, in the upwardly directed position 140, the coating material within the supply vessel 114 does not exert pressure on the removable cover 134, and therefore, the danger of an accidental spill of the coating material is greatly reduced or eliminated.

Thus, the swivel assembly 150 may advantageously improve the flow of liquid material, resulting in increased operational efficiency over prior art spray devices. Because the swivel assembly 150 may be used to improve or optimize the relative positional relationship between the supply vessel 114 and the spray gun 12, the weight of the liquid material may be used to advantage to force the liquid material into the spray gun 12 over a broader range of operating conditions. The spray assembly 100 may therefore exhibit improved transfer efficiency over prior art spray assemblies throughout a variety of operating conditions.

Figure 10:
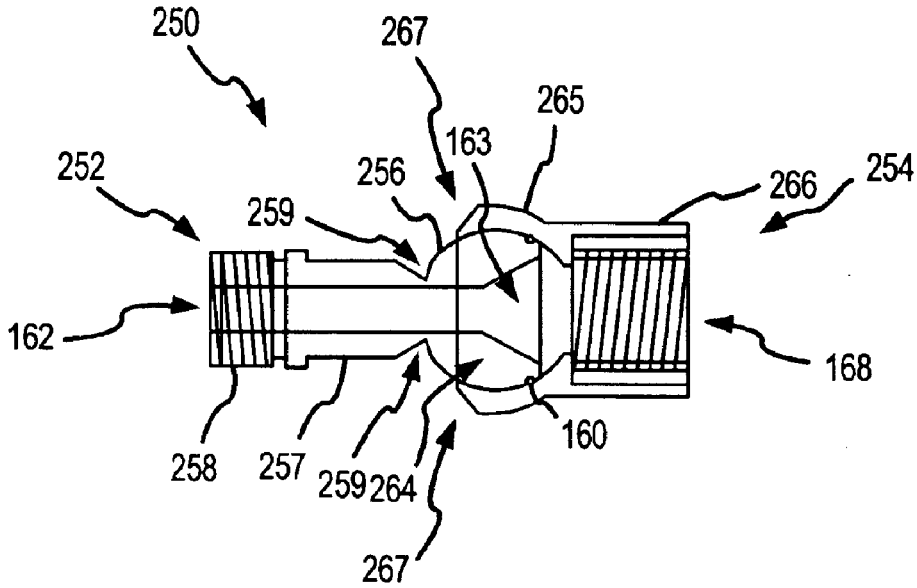
FIG. 10 is a side elevational view of a swivel assembly in accordance with an alternate embodiment of the invention.

FIG. 10 is side elevational view of a swivel assembly 250 in accordance with an alternate embodiment of the invention. In this embodiment, the swivel assembly 250 includes a first engagement member 252 having a partially-spherical protruding portion 256 that engages with a concavity 264 of a second engagement member 254. An elongated connector portion 257 extends between the protruding portion 256 and a threaded base portion 258. The elongated connector portion 257 includes a "necked-down" or cut-back portion 259 proximate the protruding portion 256. As described above with respect to FIG. 4, the first engagement member 252 has a first passageway 162 disposed therethrough including a flared or conical segment 163 proximate to the second engagement member 254.

As further shown in FIG. 10, the second engagement member 254 has an outer wall 265 that surrounds and forms the concavity 264 and that includes a tapered end portion 267. The second engagement member 254 also includes a mounting portion 266 that threadedly engages the mounting nipple 28 on the spray gun 14 in the manner described above. A second passageway 168 is disposed through the second engagement member 254.

In operation, as the protruding portion 256 of the first engagement member 252 is pivoted within the concavity 264 of the second engagement member 254, the tapered end portion 267 of the outer wall 265 slides into the cut-back portion 259 of the first engagement member 252. The combination of the tapered end portion 267 and the cut-back portion 259 advantageously enable the first and second engagement members 252, 254 to pivot through a greater tilt angle A (FIG. 7) than could otherwise be achieved using the previously described embodiment. Thus, the swivel assembly 250 may provide additional operational advantages by enabling the relative positional relationship between the supply vessel 114 and the spray gun 12 to be further improved or optimized over a greater range of operating conditions.

Figure 11:
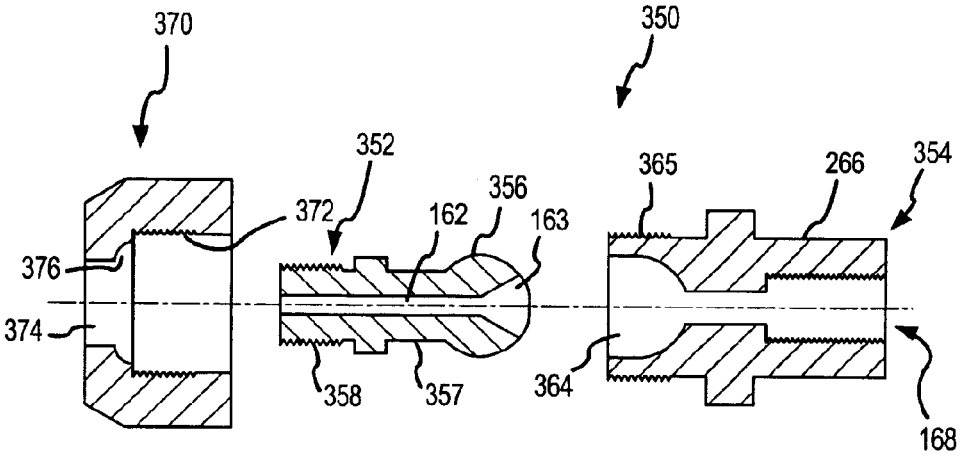
FIG. 11 is a cross sectional exploded side view of a swivel assembly in accordance with another alternate embodiment of the invention.

FIG. 11 is a cross sectional exploded side view of a swivel assembly 350 in accordance with another alternate embodiment of the invention. The swivel assembly 350 includes a first engagement member 352 having a partially-spherical protruding portion 356 that is received by a concavity 364 of a second engagement member 354. A connector portion 357 extends between the partially-spherical protruding portion 356 and a threaded base portion 358. The first engagement member 352 has a first passageway 162 disposed therethrough including a flared or conical segment 163 extending into the first engagement member 352.

Still referring to FIG. 11, the second engagement member 354 has external threads 365 formed thereon to receive a mounting collar 370 that includes internal threads 372. The mounting collar 370 further includes an opening 374 disposed in the collar 370 that permits the threaded base portion 358 to be received through the opening 374. The opening 374 further includes a partially spherical inner face 376 to engage a portion of the protruding portion 356. The second engagement member 354 also includes a mounting portion 266 that threadedly engages the mounting nipple 28 on the spray gun 12, as shown in FIG. 3. A second passageway 168 is also disposed through the second engagement member 354 that is aligned with the first passageway 162 to allow the first engagement member 352 and the second engagement member 354 to fluidly communicate.

Figure 12:
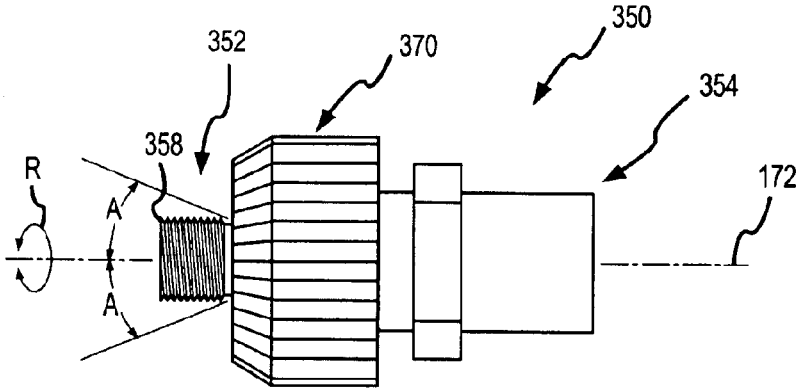
FIG. 12 is a side elevational view of the swivel assembly of FIG. 11.

Referring now to FIGS. 11 and 12, as the partially-spherical protruding portion 356 of the first engagement member 352 engages the concavity 364 of the second engagement member 354, the internal threads 372 of the mounting collar 370 engage the external threads 365 on the first engagement member 352 to retain the protruding portion 356 within the concavity 364. The opening 374 has a diameter that is sufficiently large to permit the connector portion 357 to be moved within the opening 374 so that the first engagement member 352 may be pivoted through the pivot angle A in any direction with respect to the longitudinal axis 172 so that the supply vessel 114 (as shown in FIG. 3) may be readily positioned in a desired orientation. The swivel assembly 350 similarly permits the first engagement member 352 to be rotated in either direction, as shown by the arrow R.

The swivel assembly 350 provides still other operational advantages by allowing a desired amount of friction to be developed between the first engagement member 352 and the second engagement member 354 by applying a corresponding torque to the collar 370. Consequently, the relative positions of the supply vessel 114 and the spray gun 12 (as shown in FIG. 3) may be readily adjusted and then retained in the selected position.

As noted above, the various disclosed embodiments of the inventive swivel assembly may provide significant operational advantages over the prior art spray assembly 10, including increased efficiency, reduced labor costs, and reduced risks of spillage. Although the above-described embodiments are described in terms of a spray gun for liquid coating materials, it is understood that swivel assemblies in accordance with the invention may alternately be used on a wide variety of applicator devices, including paint pads, squeegees, sprayers, porous members, or other types of applicator devices that may be used to apply paint, varnish, clear coat, wax, stain, cleaners, solvents, or any other type of liquid material to a surface of a workpiece.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other apparatus and methods for swivel attachment of supply vessels to applicator devices, and not just to the embodiments described above and shown in the accompanying figures. Accordingly, the scope of the invention should be determined from the following claims.

What is claimed is:

1. An apparatus for applying a liquid coating material, comprising:

a spray gun applicator device having a dispenser assembly and a nozzle;

a gravity feed supply vessel having an interior volume; and a swivel assembly coupled between the supply vessel and the applicator device, the swivel assembly including a first engagement member having a protruding portion and a first passageway disposed therethrough, and a second engagement member having a concavity and a second passageway disposed therethrough, the first passageway of the first engagement member and the second passageway of the concavity each having interior walls defining a fluid conduit, and the protruding portion being moveably engaged within the concavity such that the interior volume of the supply vessel fluidly communicates with the applicator device through the first and second passageways whereby fluid flows through the fluid conduit in direct contact with the interior walls and whereby the gravity feed supply vessel is rotatable in any direction with respect to the spray gun applicator while maintaining the nozzle and the dispenser in a fixed orientation with respect to one another.

2. The apparatus according to claim 1 wherein the first engagement member is attached to the supply vessel and the second engagement member is attached to the applicator device.

3. The apparatus according to claim 1, further comprising a collar that couples the first engagement member and the second engagement member.

4. The apparatus according to claim 3, wherein the collar is configured to retain the protruding portion of the first engagement member and the concavity of the second engagement member.

5. The apparatus according to claim 1 wherein the protruding portion comprises a partially spherical portion and wherein the concavity comprises a partially spherical concavity.

6. The apparatus according to claim 1 wherein the protruding portion is rotatably and pivotally moveable within the concavity.

7. The apparatus according to claim 1 wherein the first engagement member includes a recessed portion proximate the protruding portion, the recessed portion being sized to receive a portion of the second engagement member when the second engagement member is pivoted with respect to the first engagement member.

8. The apparatus according to claim 1 wherein the second engagement member includes an outer wall surrounding the concavity, the outer wall including a tapered end portion.

9. The apparatus according to claim 1 wherein the second engagement member includes an outer wall surrounding the concavity, the outer wall including a tapered end portion, and wherein the first engagement member includes recessed portion proximate the protruding portion, the recessed portion being sized to at least partially receive the tapered end portion when the second engagement member is pivoted with respect to the first engagement member.

10. The apparatus according to claim 1 wherein the first engagement member is threadedly coupled to the supply vessel and the second engagement member is threadedly coupled to the applicator device.

11. The apparatus according to claim 1, further comprising a pressure source coupled to the applicator device.

12. A swivel assembly for coupling a gravity feed supply vessel to a spray gun applicator device having a dispenser assembly and a nozzle for applying a liquid coating material, comprising a first engagement member having a protruding portion and a first passageway disposed therethrough, and a second engagement member having a concavity and a second passageway disposed therethrough, the first passageway of the first engagement member and the second passageway of the concavity each having interior walls defining a fluid conduit, and, the protruding portion being moveably engaged within the concavity, the first passageway being in fluid communication with the second passageway such that the supply vessel fluidly communicates with the applicator device through the first and second passageways, whereby fluid flows through the fluid conduit in direct contact with the interior walls and whereby the gravity feed supply vessel is rotatable in any direction with respect to the spray gun applicator while maintaining the nozzle and the dispenser in a fixed orientation with respect to one another.

13. The apparatus according to claim 12 wherein the protruding portion is rotatably and pivotally moveable within the concavity.

14. The assembly according to claim 12, further comprising a collar that couples the first engagement member and the second engagement member.

15. The apparatus according to claim 14, wherein the collar is configured to retain the protruding portion of the first engagement member within the concavity of the second engagement member.

16. The apparatus according to claim 15, wherein the collar includes a first threaded portion and the second engagement member includes a second threaded portion engageable with the first threaded portion, the collar being selectively adjustable to obtain a desired positional orientation between the first engagement member and the second engagement member.

17. The apparatus according to claim 12 wherein the protruding portion comprises a partially spherical protruding portion and wherein the concavity comprises a partially spherical concavity.

18. The apparatus according to claim 12 wherein the first engagement member is adapted to be engaged with the supply vessel and the second engagement member is adapted to be engaged with the applicator device.

19. A method of supplying a liquid material to a spray gun applicator device having a dispenser assembly and a nozzle, comprising:

coupling a gravity feed supply vessel to the applicator device using a swivel assembly, the swivel assembly including a first engagement member having a concavity therein and a first passageway therethrough, and a second engagement member having a protrusion and a second passageway disposed therethrough, the protrusion being moveably engaged within the concavity and the first passageway being in fluid communication with the second passageway; the first passageway of the first engagement member and the second passageway of the concavity each having interior walls defining a fluid conduit, and providing the liquid material into the supply vessel; and flowing the liquid material from the supply vessel through the first and second passageways to the applicator device passageways whereby fluid flows through the fluid conduit in direct contact with the interior walls and whereby the gravity feed supply vessel is rotatable in any direction with respect to the spray un applicator while maintaining the nozzle and the dispenser in a fixed orientation with respect to one another.

20. The method according to claim 19 wherein coupling a supply vessel to the applicator device using a swivel assembly comprises coupling a supply vessel to the applicator device using a swivel assembly wherein the concavity comprises a partially spherical concavity and wherein the protrusion comprises a partially spherical protrusion.

21. The method according to claim 19, wherein coupling a supply vessel to the applicator device using a swivel assembly further comprises coupling the first engagement member and the second engagement member with a collar.

22. The method according to claim 21, wherein coupling the first engagement member and the second engagement member with a collar further comprises retaining at least a part of the protruding portion of the first engagement member within the concavity of the second engagement member.

23. The method according to claim 22, wherein the collar includes a first threaded portion and the second engagement member includes a second threaded portion engageable with the first threaded portion, and retaining at least a part of the protruding portion of the first engagement member within the concavity of the second engagement member further comprises engaging the first threaded portion and the second threaded portion and applying a desired torque to the collar to retain a desired positional orientation between the first engagement member and the second engagement member.

24. The method according to claim 19 wherein coupling a supply vessel to the applicator device using a swivel assembly comprises coupling a supply vessel to the applicator device using a swivel assembly wherein the protrusion is rotatably and pivotally moveable within the concavity.

25. The method according to claim 19 wherein coupling a supply vessel to the applicator device using a swivel assembly comprises coupling a supply vessel to the applicator device using a swivel assembly wherein the protrusion is pivotally moveable within the concavity.

26. The method according to claim 19 wherein flowing the liquid material from the supply vessel through the first and second passageways to the applicator device includes flowing compressed gas through the applicator device.

27. The method according to claim 19, further comprising pivoting the protrusion within the concavity such that a first longitudinal axis of the first passageway is not aligned with a second longitudinal axis of the second passageway.

* * * * *

UNITED STATES PATENT AND TRADEMARK OFFICE

CERTIFICATE OF CORRECTION

PATENT NO. : 6,863,227 B2 
DATED : March 8, 2005
INVENTOR(S) : Skye Lechner Wollenberg and Neil Garrett Stockman It is certified that error appears in the above-identified patent and that said Letters Patent is hereby corrected as shown below:

Column 5,
Line 22, "of the workpiece 22 being covered be loading of the supply" should read -- of the workpiece 22 being covered by loading of the supply --.

Column 9,
Line 39, "in any direction with respect to the spray un applicator" should read -- in any direction with respect to the spray gun applicator --.

Signed and Sealed this

Tenth Day of January, 2006

JON W. DUDAS
*Director of the United States Patent and Trademark Office*